US005257867A

United States Patent [19]

Ito et al.

[11] Patent Number: 5,257,867

[45] Date of Patent: Nov. 2, 1993

[54] PRINTER WITH PRINT GAP CONTROL

[75] Inventors: Noritsugu Ito, Chita; Yasunari Yoshida, Ama; Satoshi Uchiyama, Kani, all of Japan

[73] Assignee: Brother Kogyo Kabushiki Kaisha, Aichi, Japan

[21] Appl. No.: 954,900

[22] Filed: Sep. 30, 1992

[30] Foreign Application Priority Data

Oct. 4, 1991 [JP] Japan ..... 3-285726

[51] Int. Cl.[5] ..... B41J 25/28; B41J 11/20

[52] U.S. Cl. ..... 400/56; 400/57; 400/59; 400/124

[58] Field of Search ..... 400/55, 56, 57, 59, 400/124

[56] References Cited

U.S. PATENT DOCUMENTS

| | | | |
|---|---|---|---|
| 4,652,153 | 3/1987 | Kotsuzumi et al. | 400/56 |
| 4,676,675 | 6/1987 | Suzuki et al. | 400/59 |
| 4,990,004 | 2/1991 | Kawahara et al. | 400/56 |
| 5,037,217 | 8/1991 | Suzuki et al. | 400/124 |
| 5,051,008 | 9/1991 | Honda et al. | 400/59 |
| 5,074,685 | 12/1991 | Shimizu et al. | 400/56 |
| 5,118,209 | 6/1992 | Bennet et al. | 400/56 |
| 5,156,464 | 10/1992 | Sakai | 400/55 |
| 5,156,466 | 10/1992 | Inagaki | 400/56 |

*Primary Examiner*—Eugene H. Eickholt

*Attorney, Agent, or Firm*—Kane, Dalsimer, Sullivan, Kurucz, Levy, Eisele and Richard

[57] ABSTRACT

A printer having an adjusting apparatus for adjusting a head gap between a print head and a print sheet supported on a platen, is disclosed. In such printer, at first, a carriage 1 mounting the print head 8 thereon is advanced to the print sheet 6 by eccentrically rotating a guide bar 3 passed through a slide hole 1*a* with a solidable lubricant therebetween through a step motor 12 until a ribbon mask 9 contacts to the print sheet 6. And a drive pulse number Nm, which is input to the step motor 12 until the ribbon mask 9 contacts to the print sheet 6 and corresponds to moving distance of the carriage 1 from a standard position O, is calculated. Further, a value Na (=N1−Nm) representing a drive pulse number for the step motor 12 corresponding to a thickness of the print sheet 6, is calculated. Here, the N1 is a drive pulse number necessary to advance the carriage 1 toward the platen 2 till the ribbon mask 9 contacts to the platen 2 in case that the print sheet 6 is not supported on the platen 2 and stored in a NVRAM 29. Next, it is judged whether the calculated Na is bigger than or equal to a NaO which is stored in a ROM 25 and corresponds to a drive pulse number for the step motor 12 necessary to obtain the optimum gap between the print head 8 and the print sheet 6 when the print sheet 6 with 0.4 mm thickness is utilized.

16 Claims, 10 Drawing Sheets

Fig. 7A

| ITEM | INSTRUCTION |
|---|---|
| S1 | RETRACT CARRIAGE TO STANDARD POSITION O |
| S2 | MOVE CARRIAGE TOWARD HOME POSITION |
| S3 | DETECT HOME POSITION ? |
| S4 | MOVE CARRIAGE TO SHEET THICKNESS DETECTING POSITION |
| S15 | PRINT ORDER IS INPUT TO CPU ? |
| S5 | FEED PRINT SHEET TO PLATEN |
| S6 | ADVANCE CARRIAGE TOWARD PLATEN |
| S7 | CARRIAGE IS STOPPED ? |
| S8 | CALCULATE PULSE NUMBER Nm |
| S9 | CALCULATE PULSE NUMBER Na ( = N1 - Nm ) |
| S10 | JUDGE WHETHER Na $\geqq$ NaO |
| S11 | ROTATE FORCIBLY GUIDE BAR IN SLIDE HOLE |
| S12 | RETRACT CARRIAGE TO STANDARD POSITION O |
| S13 | READ OUT PULSE NUMBER Nb FROM ROM |
| S14 | CALCULATE ( Nm - Nb ) |
| S16 | PRINTING OPERATION |
| S17 | RETRACT CARRIAGE TO STANDARD POSITION O |
| S18 | FEED OUT PRINTED SHEET FROM PLATEN |

Fig. 7B

| ITEM | INSTRUCTION |
|---|---|
| S20 | RETRACT CARRIAGE TO STANDARD POSITION O |
| S21 | MOVE CARRIAGE TO A POSITION EXCEPT FOR SHEET THICKNESS DETECTING POSITION |
| S22 | PRINT ORDER IS INPUT TO CPU ? |
| S23 | MOVE CARRIAGE TO SHEET THICKNESS DETECTING POSITION |
| S24 | FEED PRINT SHEET TO PLATEN |
| S25 | ADVANCE CARRIAGE TOWARD PLATEN |
| S26 | CARRIAGE IS STOPPED ? |
| S27 | CALCULATE PULSE NUMBER Nm |
| S28 | CALCULATE PULSE NUMBER Na ( = N1 - Nm ) |
| S29 | READ OUT PULSE NUMBER Nb FROM ROM |
| S30 | CALCULATE ( Nm - Nb ) |

Fig. 7C

| ITEM | INSTRUCTION |
|---|---|
| S40 | RETRACT CARRIAGE TO A POSITION EXCEPT FOR STANDARD POSITION O |
| S41 | MOVE CARRIAGE TO SHEET THICKNESS DETECTING POSITION |
| S42 | FEED PRINT SHEET TO PLATEN |
| S43 | PRINT ORDER IS INPUT TO CPU ? |
| S44 | RETRACT FORCIBLY CARRIAGE TO STANDARD POSITION |
| S45 | ADVANCE CARRIAGE TOWARD PLATEN |
| S46 | CARRIAGE IS STOPPED ? |
| S47 | CALCULATE PULSE NUMBER Nm |
| S48 | CALCULATE PULSE NUMBER Na ( = N1 - Nm ) |
| S49 | READ OUT PULSE NUMBER Nb FROM ROM |
| S50 | CALCULATE ( Nm - Nb ) |

Fig. 7D

| ITEM | INSTRUCTION |
|---|---|
| S60 | RETRACT CARRIAGE TO STANDARD POSITION O |
| S61 | MOVE CARRIAGE TO SHEET THICKNESS DETECTING POSITION |
| S62 | PRINT ORDER IS INPUT TO CPU ? |
| S63 | FEED PRINT SHEET TO PLATEN |
| S64 | JUDGE WHETHER TIMER HAS COUNTED X MINUTES |
| S65 | ADVANCE FORCIBLY CARRIAGE TOWARD PLATEN |
| S66 | RETRACT CARRIAGE TO STANDARD POSITION O |
| S67 | ADVANCE CARRIAGE TOWARD PLATEN |
| S68 | CARRIAGE IS STOPPED ? |
| S69 | CALCULATE PULSE NUMBER Nm |
| S70 | CALCULATE PULSE NUMBER Na ( = N1 - Nm ) |
| S71 | READ OUT PULSE NUMBER Nb FROM ROM |
| S72 | CALCULATE ( Nm - Nb ) |

PRINTER WITH PRINT GAP CONTROL

BACKGROUND OF THE INVENTION

1. Field of the Invention

The present invention relates to a printer having an adjusting apparatus of head gap between a print head and a print sheet supported on a platen. In particular, the invention relates to the the printer in which the head gap can be correctly adjusted in case that the print head commences to move for printing after being maintained in nonuse state for a long time subsequent to that the printer is powered on.

2. Description of the Related Art

Generally, in a printer, it has come to be necessary to adjust a head gap between a print head and a print sheet supported on a platen, in order to maintain a high printing quality coresponding to various thickness of the print sheet. Thus, conventionally, various kinds of printers having a head adjusting device by which the head gap between the print head and the print sheet supported on the platen is properly adjusted corresponding to the thickness of the print sheet, are proposed. In U.S. Pat. No. 4,990,004, for instance, a printer having an automatic head gap adjusting device and an operator-controlled head gap adjusting device is disclosed. In such the printer, the head gap between the print head and the print sheet is automatically or manually adjusted according to the selected mode by a mode selector. Here, as shown in FIG. 1 of that U.S. patent, the print head 14 is mounted on a carriage 16, which has an integrally formed hollow cylindrical slide 17 slidably engaging a support shaft 18 parallel to the platen 10. And the slide 17 and the support shaft 18 are axially movable relative to each other.

Generally, lubricant is filled in a gap formed between the cylindrical slide 17 and the support shaft 18 so that the both the cylindrical slide 17 and the support shaft 18 can rotate relative to each other. Based on the above construction, the print head 14 is advanced to and retracted from the platen 10 according to forward and backward rotation of the support shaft 18 which is rotated by a driving mechanism connected to an eccentric end portion 26 formed on one end of the support shaft 18.

However, in general, the lubricant existing between the cylindrical slide 17 and the support shaft 18 has a characteristic to solidify itself if it is left for a long time as it is. Therefore, in case that the carriage 16 is moved for printing after being maintained in non-moving state for a long time, it is possible that the cylindrical slide 17 and the support shaft 18 are temporarily adhered and fixed each other due to solidification of the lubricant.

And in case of the print sheet thickness detection, the print head 16 is advanced and pressed to the print sheet with relatively small driving force so that a pressing mark by the print head 14 does not remain on the print sheet. Accordingly, when adhering or fixing force between the cylindrical slide 17 and the support shaft 18 is larger than the driving force for advancing the print sheet, the carriage 16 cannot be advanced to the print sheet.

Therefore, if, under the above condition, detecting of the print sheet thickness is conducted in order to calculate the optimum head gap, detecting error occurs because the cylindrical slide 17 and the support shaft 18 cannot rotate each other, therefore, the optimum head gap cannot be obtained. As a result, correct printing by the print head 14 cannot be conducted. In particular, if the print head 14 is a wire print head, print wires installed in the print head cannot reach to the print sheet supported on the platen 10, thus, correct printing cannot be conducted.

Here, there is no problem in a case that the printer is again utilized after powered off, since, in such case, the carriage 14 executes an initial operation in which the carriage 14 is retracted from the platen 10 to a standard position in an advance/retraction direction and further moved along the platen 10 to a standard position in a left/right direction, therefore, adhering or fixing between the cylindrical slide 17 and the support shaft 18 caused by solidification of the lubricant is removed.

However, in general usage of the printer, there is a case that printing of one page or so is conducted after powered on, and thereafter, the printer is left in nonuse state for a long time (several ten minutes). In this case, since the carriage 14 is stopped at a predetermined position for gap adjusting, the gap adjusting operation is immediately conducted in response to sheet feeding order from control device without moving of the carriage 14. In such case that the gap adjusting operation is conducted after the printer is left in nonuse state for a long time, the lubricant existing between the cylindrical slide 17 and the support shaft 18 is possibly solidified when the gap adjusting operation is conducted. According, detecting error in the gap adjusting will occur as mentioned above.

Further, for instance, in U.S. patent application Ser. No. 07/849,972, now U.S. Pat. No. 5,047,956 filed by the same applicant of the present invention, a printer having a gap adjusting apparatus for a print head is disclosed. In such printer, the gap adjusting apparatus similar to the above gap adjusting apparatus is utilized. Therefore, the same problem in the above printer yet exists if the gap adjusting is conducted after the printer is left in nonuse state for a long time subsequent to power on thereof.

SUMMARY OF THE INVENTION

Accordingly, it is an object of the present invention to overcome the above mentioned problems and to provide an adjusting apparatus of head gap between a print head and a print sheet supported on a platen, in which the head gap can be correctly adjusted in case that the print head commences to move for printing after being maintained in non-moving state for a long time subsequent to that the printer is powered on.

In order to accomplish the above object, the present invention comprises a printer having a platen supporting a print sheet thereon, a carriage mounting a print head thereon, a first guide means for guiding the carriage in a first direction parallel to an axial direction of the platen, a first drive means for moving the carriage while guiding through the first guide means, a second guide means for guiding the carriage in a second direction right to the axial direction of the platen and a second drive means for moving the carriage while guiding through the second guide means, the printer comprising:

a sheet thickness detection means for detecting a thickness of the print sheet by advancing the carriage to the print sheet with a first predetermined driving force through the second drive means until the carriage is stopped, a gap setting means for setting a predetermined gap corresponding to the thickness detected by the sheet thickness detection means between the print head and the print sheet supported on the platen, a comparison means for comparing a value of the thickness detected by the sheet thickness detection means with a predetermined value, and a control means for controlling at least one of the first drive means and the second drive means so as to forcibly move the carriage with a second predetermined driving force larger than the first driving force in the first direction or the second direction before the predetermined gap is set by the gap setting means when it is judged by the comparison means that the value of the thickness is bigger than or equal to the predetermined value.

According to the present invention, the head gap between the print head and the print sheet supported on the platen can be precisely adjustable when the print head commences to move for printing after being maintained in nonuse state for a long time subsequent to that the printer is powered on.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the following drawings, wherein:

FIG. 7A is a table of labels for the flowchart of FIG. 3,

FIG. 7B is a table of labels for the flowchart of FIG. 4,

FIG. 7C is a table of labels for the flowchart of FIG. 5,

FIG. 7D is a table of labels for the flowchart of FIG. 6,

DETAILED DESCRIPTION OF THE PREFERRED EMBODIMENT

A detailed description of the preferred embodiment of an adjusting apparatus embodying the present invention will now be given referring to the accompanying drawings.

Figure 1:
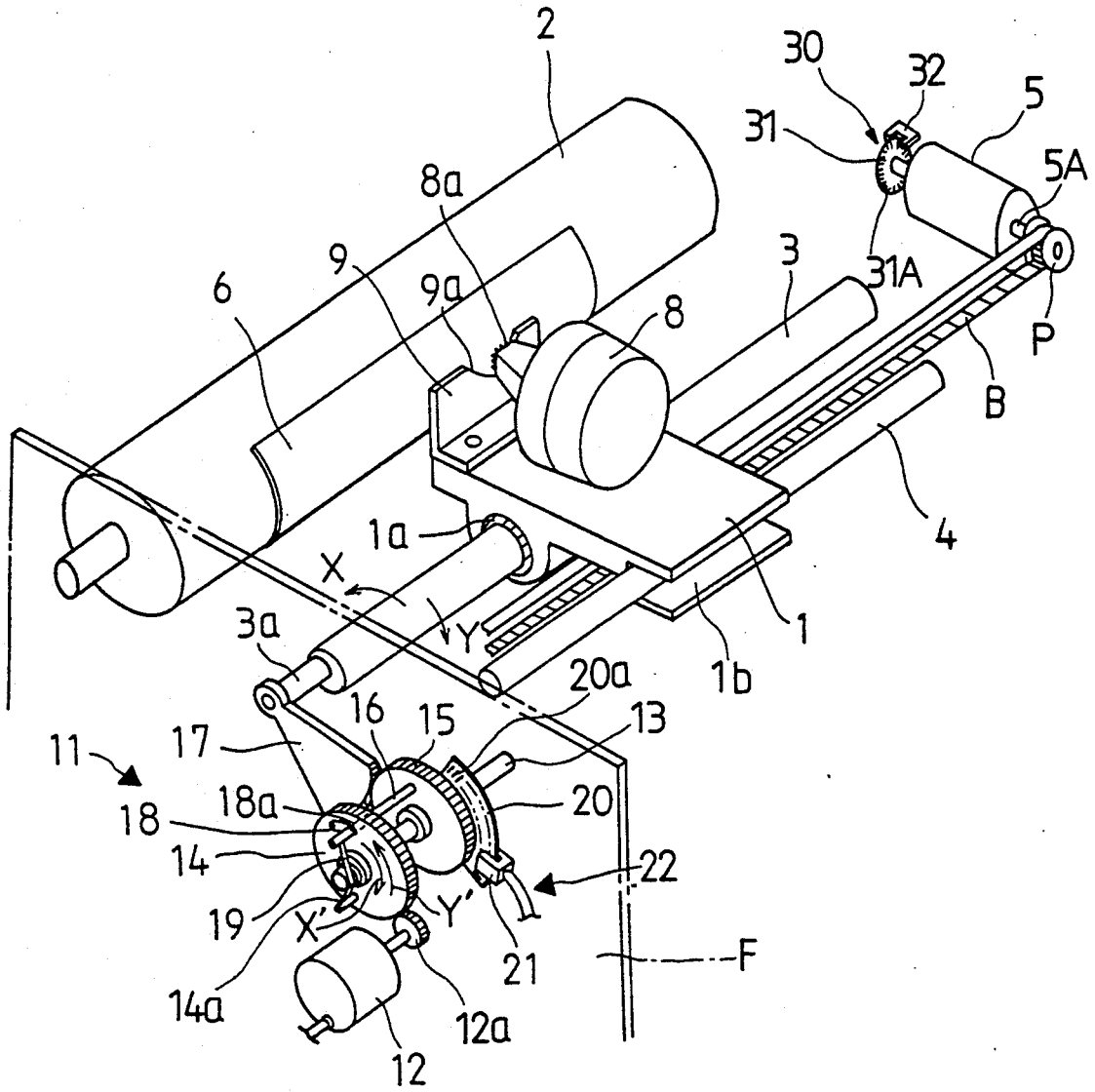
FIG. 1 is a perspective view of main part in the printer including the adjusting apparatus of the head gap, according to the embodiment of the present invention.

In FIG. 1, a main part of a dot impact type printer is shown. A guide bar 3 is rotatably arranged parallel to a cylindrical platen 2 which is rotatably supported between a pair of printer frames F (one of the printer frames F is shown in FIG. 1). And a carriage 1 in which a slide hole 1*a* is formed at the lower portion thereof, is positioned opposite to a print sheet 6 supported on the platen 2. The guide bar 3 is passed through the slide hole 1*a* so that the carriage 1 can reciprocate according to axial direction of the guide bar 3. Between the guide bar 3 and the slide hole 1*a*, lubricant is filled up such that the carriage 1 can move smoothly.

Such carriage 1 is reciprocated by a driving belt B driven through a drive motor 5, both ends of which are connected to the carriage 1 and which is strained between a pair of pulleys P ( one of the pulleys P is fixed to one end of a drive shaft 5A of the drive motor 5 and the other is rotatably supported on the printer frame F (not shown). To the other end of the drive shaft 5A of the drive motor 5, an encoder 30 is mounted. The encoder 30 comprises a turning disk 31 with a plurality of slits 31A and a photo-interrupter 32 for detecting the slits 31A through light penetration and light blockage. This encoder 30 serves to detect a home position of the carriage 1 when the carriage 1 moves leftward along the guide bar 3. The encoder 30 detects the home position based on that the photo-interrupter 32 does not detect the slits 31A of the turning disk 31 when the left side of the carriage 1 contacts to the printer frame F.

On the carriage 1, a print head 8 is mounted so that top portion of the print head 8 is directed to the platen 2. And a ribbon mask 9 with a V-shaped cutout 9*a* on the upper portion thereof, is fixed on the front end of the carriage 1. The print head 8 has 24 print wires 8*a* which are longitudinally arrayed on the front surface of the print head 8.

Therefore, the print wires 8*a* are selectively advanced toward the platen 2 when energized by wire driving devices installed in the print head 8, thereby the print wires 8*a* depresses an ink ribbon (not shown) existing between a front surface of the print head 8 and the print sheet 6 onto the print sheet 6, while passing through the cutout 9*a* of the ribbon mask 9, and characters, etc. are printed on the print sheet 6.

Further, the print head 8 conducts dot printing of characters on the print sheet 6 while moving in a horizontal direction according to movement of the carriage 1. And the print sheet 6 is fed line by line each that one line printing is completed, by the platen 2 rotated through a sheet feeding device 10 (shown in FIG. 2).

Next, the adjusting apparatus according to the embodiment of the present invention will be described referring to FIG. 1. In FIG. 1, the guide bar 3 is rotatably supported by a pair of eccentric shafts 3*a* which are formed on the both ends of the guide bar 3 (one of the eccentric shafts 3*a* is shown in FIG. 1), thereby the carriage 1 mounting the print head 8 is advanced to and retracted from the platen 2 by rotating the guide bar 3 around the eccentric shafts 3*a* as a center of rotation.

At the rear end of the carriage 1, a slide groove 1*b* is provided and a fixed bar 4 fixed between the printer frames F is loosely coupled in the slide groove 1*b*, thereby the carriage 1 is able to move forward and backward against the platen 2 in being supported by the slide groove 1*b* and the fixed bar 4, when the carriage 1 advances to and retracts from the platen 2.

End of the eccentric shaft 3*a* is also connected to a contact/release mechanism 11. In the contact/release mechanism 11, a rotational force of a step motor 12 is transmitted to a driving gear 14 fixed on a shaft 13, at a reduced speed through a gear 12a. And rotational force of the driving gear 14 is transmitted to a driven gear 15 rotatably provided on the shaft 13 through the action of a pin 16, further rotational force of the driven gear 15 is transmitted to a swing gear 17 fixed to the end portion of the eccentric shaft 3a.

Here, the pin 16 has one end fixed to the one side surface of the driven gear 15 and the other end inserted through an elongated curvilinear hole 18 formed parallel to the outer circumstance of the driving gear 14 thereon. And a twist coil spring 19 is mounted to the end portion of the shaft 13, one end of the twist coil spring 19 being contacted to a fixed pin 14a on the side surface of the driving gear 14 and the other end of the twist coil spring 19 being contacted to the pin 16. Thereby, the pin 16 is continuously biased toward one end portion of the elongated hole 18 by the twist coil spring 19.

Consequently, the rotation of the driving gear 14 in the direction of an arrow Y' caused by the forward rotation of the step motor 12 is directly transmitted to the driven gear 15 and, therefore, the guide bar 3 is rotated toward the direction indicated by an arrow Y around the eccentric shafts 3a. Accordingly, the print head 8 on the carriage 1 retracted so as to be further separated from the platen 2.

In a similar manner, the rotation of the driving gear 14 in the direction indicated by an arrow X', caused by the reverse rotation of the step motor 12, is transmitted to the driven gear 15 through the twist coil spring 19 so as to rotate the guide bar 3 in the direction indicated by an arrow X around the eccentric shafts 3a. Thus, the print head 8 on the carriage 1 is advanced to the platen 2.

In this case, the advance movement of the print head 8 is restricted when the ribbon mask provided at the fore end of the print head 8 contacts the print sheet 6 supported on the platen 2. If the load torque of the driven gear 15 is increased beyond a predetermined value due to this restriction, the twist coil spring 19 is deformed. Therefore, the rotational force of the driving gear 14 is no longer transmitted to the pin 16 and the driven gear 15 is stopped. In other words, a pressing force generated when the ribbon mask 9 provided on the front end of the print head 8 is pressed on the platen 2 or the printing sheet 6, becomes a pressure corresponding to the spring force of the twist coil spring 19.

There is also, in the contact/release mechanism 11, an encoder 22 having a turning disk 20 with a plurality of slits 20a mounted on the other side surface of the driven gear 15 and a photo-interrupter 21 for detecting penetration or blockage of the light through the slit 20a of the turning disk 20. The encoder 22 serves to detect that the driven gear 15 is stopped when the ribbon mask 9 is pressed to the platen 2 or the print sheet 6 and to control stopping of the print head 8 at a predetermined position (hereinafter, referred to as "a standard position O") sufficiently far from the platen 2. An output generated from the encoder 22 is supplied to a control apparatus 23, which is described in detail later.

Figure 2:
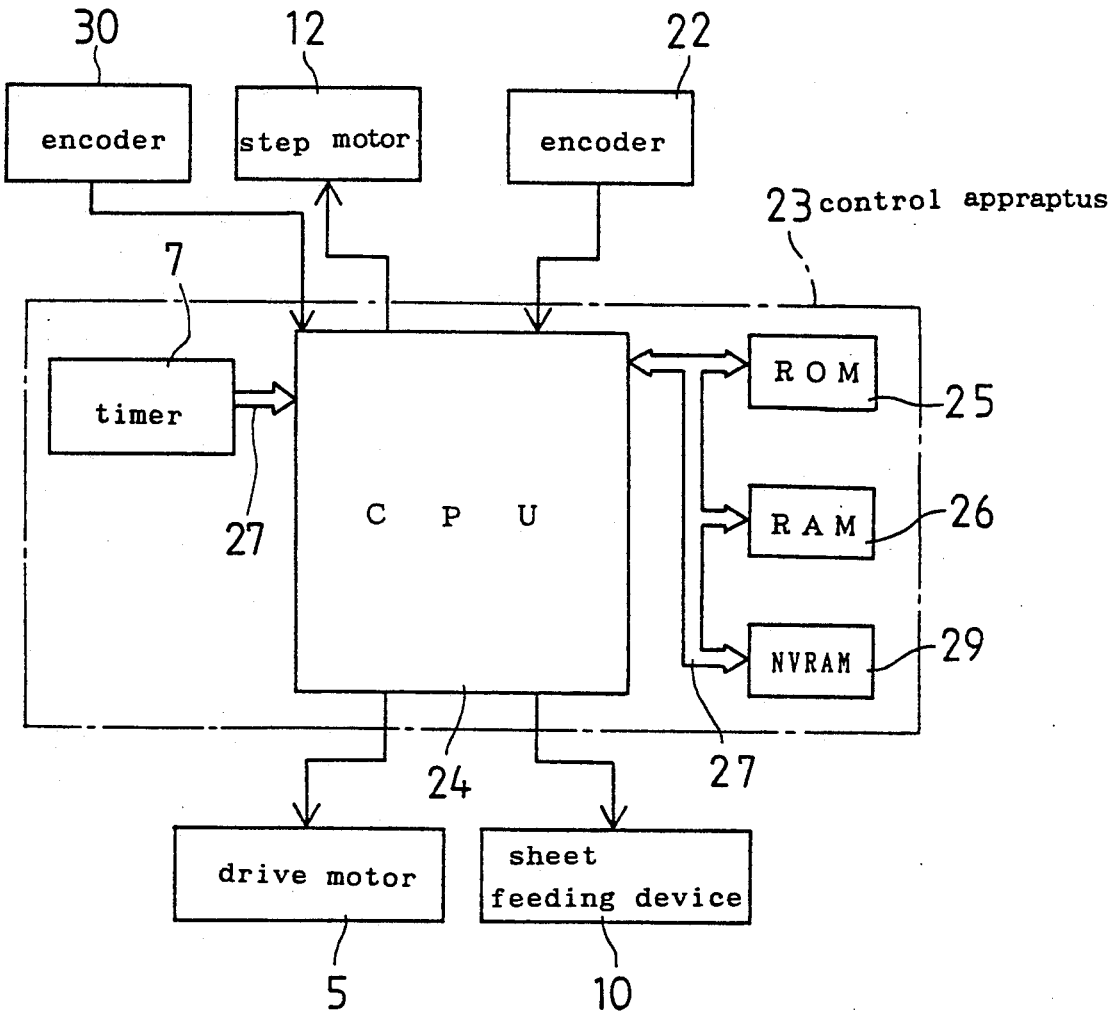
FIG. 2 is a block diagram showing an electric construction of the printer, for controlling the adjusting apparatus of the head gap, according to the embodiment of the present invention.

Next, referring to FIG. 2, a control apparatus of the printer will be described. A main control apparatus 23 comprises a CPU 24, a ROM 25, a RAM 26, a NVRAM 29 and a timer 7. The CPU 24 executes various calculations according to head gap control program (later mentioned).

The ROM 25 permenently stores head gap adjusting control program (later mentioned) and various data therein. In the concrete, Nb data as a drive pulse number necessary to advance the carriage 1 from the standard position O to a position where the optimum gap is formed between the print head 8 and the print sheet 6, is stored in the ROM 25. Here, that is to say, the Nb data relates to the gap that is optimum for performing a print operation according to the thickness of the print sheet 6 (i.e., experimentally obtained data defining the appropriate gap corresponding to the thickness of the print sheet 6).

And, in the ROM 25, NaO data is stored which represents a drive pulse number necessary to move the carriage 1 through the step motor 12 by a distance of 0.4 mm corresponding to a 0.4 mm thickness of the print sheet 6. The print sheet 6 is hypothetically supposed to be the thickest print sheet capable of being supported on the platen 2.

Further, data as drive pulse number of the step motor 5 necessary to stop the carriage 1 at a position where the thickness of the print sheet 6 is detected, is stored in the ROM 25. Such drive pulse number is detected by the encoder 30. In this embodiment, such thickness detecting position is set to the left side from the central position of the platen 2 in a axial direction thereof.

Figure 6:
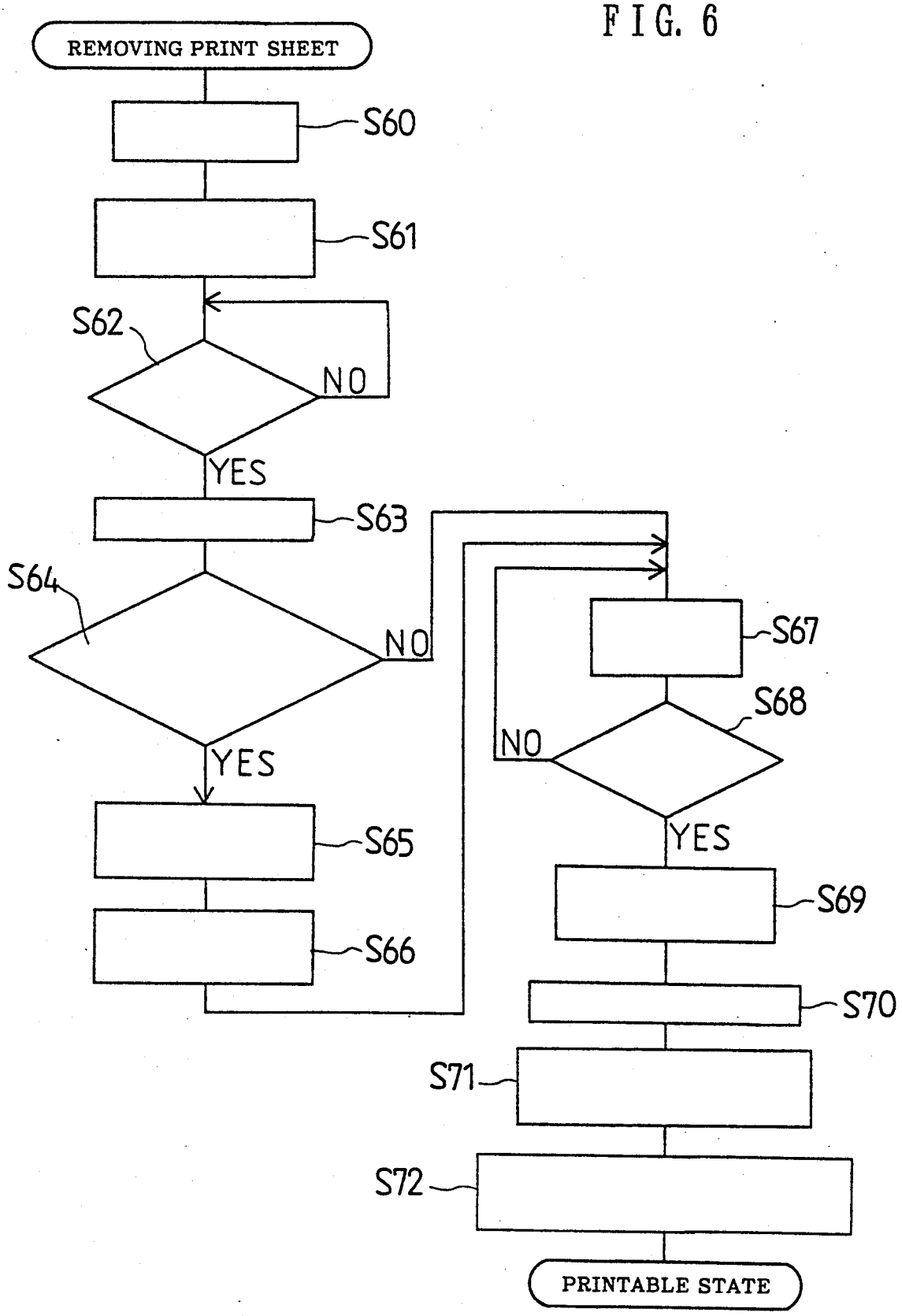
FIG. 6 is a flowchart showing the fourth control procedure of the adjusting apparatus of the head gap, according to the embodiment of the present invention.

The RAM 26 temporarily stores various data calculated by the CPU 24. And the nonvolatile NVRAM 29 stores N1 data as a drive pulse number necessary to advance the carriage 1 toward the platen 2 till the ribbon mask 9 contacts to the platen 2 in case that the print sheet 6 is not supported on the platen 2. This drive pulse number is measured and predetermined in manufacturing process thereof. The timer 7 counts 5–10 minutes since last driving of the step motor 12 is terminated, when the flowchart shown in FIG. 6 is executed. The CPU 24, the ROM 25, the RAM 26, the NVRAM 29 and the timer 7 are mutually connected through a bass line 27.

The encoder 22 and the step motor 12 are connected to the CPU 24 and the CPU 24 drives the step motor 12 based on the detected output from the encoder 22, thereby the guide bar 3 is rotated to the direction X or Y around the eccentric shafts 3a. As a result, the print head 8 on the carriage 1 is advanced to or retracted from the platen 2. And the encoder 30 and the drive motor 5 are connected to the CPU 24 and the CPU 24 drives the motor 5 based on the detected output from the encoder 30 so that the carriage 1 is moved leftward and stopped at the home position through the pulley P and the driving belt B. The carriage 1 is moved reciprocally while printing by the print head 8. Further, the CPU 24 controls the drive motor 5 based on the data of the thickness detecting position stored in the ROM 25, so that the carriage 1 is stopped at the thickness detecting position.

The sheet feeding device 10 is connected to the CPU 24, thereby the CPU 24 controls the sheet feeding device 10 when feeding the print sheet 6 to the platen 2, removing the print sheet 6 from the platen 2 and feeding the print sheet 6 line by line while printing by the print head 8.

Next, the first control procedure of the gap adjusting apparatus above constructed will be described hereinafter, referring to FIGS. 3 and 7A. After powering on of the printer, an initial operation is conducted. In the initial operation, the step motor 12 is driven and the guide bar 3 is rotated in the direction Y through the gear 12*a* driven by the step motor 12, the driving gear 14 rotated in the direction Y', the pin 16, the driven gear 15, the swing gear 17 and the eccentric shaft 3*a* until the encoder 22 does not detect the slits 20*a* of the returning disk 20. Thereby, the carriage 1 is retracted to the standard position O in step (abbreviated S hereinafter) 1.

Here, this retracting of the carriage 1 is done based on the output from the encoder 22. That is to say, the encoder 22 outputs pulses corresponding to the slits 20*a* detected by the photo-interrupter 21, to the CPU 24 while the carriage 1 is retracting. On the other hand, the encoder 22 does not output such pulses when the carriage 1 reaches to the standard position O. Then, the CPU 24 stops driving of the step motor 12 by detecting that the pulses are not input thereto. Instead of the above, it will be conceivable that the turning disk 20 is out of the photo-interrupter 21 when the carriage 1 comes to the standard position O. Further, it will be possible that the photo-interrupter 21 does not detect the slits 20*a* of the turning disk 20 when the carriage 1 contacts to a stopper (not shown) arranged at the standard position O.

And the carriage 1 is moved leftward through the pulley P driven by the drive motor 5 and the driving belt B along the platen 2 toward the home position until the encoder 30 detects that the carriage 1 reaches to the home position where the photo-interrupter 32 does not detect the slits 31A of the turning disk 31 (S2, S3). So long as the encoder 30 does not detect that the carriage 1 reaches to the home position (S3: NO), the procedure is waited.

If the encoder 30 detects that the carriage 1 reaches to the home position (S3: YES), the carriage 1 is moved rightward to the sheet thickness detecting position through the drive motor 5 based on the data in the ROM 25 (S4). Thereafter, in S15, it is judged whether print order is input to the CPU 24 from an external apparatus. If judged YES in S15, the procedure shifts to S6, and contrarily, if judged No, the procedure is waited until the print order is input to the CPU 24.

Here, in case that the print order is not input to the CPU 24 for a long time (S15: NO), long waiting state of the procedure will occur while being maintained powering on of the printer. During such waiting state, the lubricant filled between the slide hole 1*a* and the guide shaft 3 will be solidified.

In S5, the print sheet 6 is fed to the platen 2 by the sheet feeding device 10. And the carriage 1 is advanced toward the platen 2 from the standard position O by rotating the guide shaft 3 in the direction X through the gear 12*a* driven by the step motor 12, the driving gear 14 rotated in the direction X', the pin 16, the driven gear 15, the swing gear 17 and the eccentric shaft 3*a* (S6). Thereafter, it is judged in S7 whether advancing of the carriage 1 is stopped by that the ribbon mask 9 is contacted to the print sheet 6 supported on the platen 2. This judgement is conducted by the CPU 24 based on that the photo-interrupter 21 detects stop of rotation of the turning disk 20. At this stopped position, the ribbon mask 9 is pressed onto the print sheet 6 with pressure according to biasing force of the twist coil spring 19.

If judged NO in S7, the procedure returns to S6 to advance the carriage 1 until stop of the carriage 1 is detected. And if judged YES in S7, drive of the step motor 12 is stopped. Further, in S8, pulse number Nm, which is input to the step motor 12 until it is stopped and corresponds to moving distance of the carriage 1 from the standard position O, is calculated and stored in the RAM 26. And the drive pulse number corresponding to the N1 data is read out from the NVRAM 29.

Thereafter, in S9, value Na (=N1−Nm) is calculated and stored in the RAM 26. Here, the value Na represents a drive pulse number corresponding to the thickness of the print sheet 6 supported on the platen 2. Next, in S10, it is judged whether the calculated value Na is bigger than or equal to the drive pulse number of the NaO data (Na≧NaO). If judged NO (in this state, both the guide bar 3 and the carriage 1 are mutually rotatable since the lubricant filled between the guide bar 3 and the slide hole 1*a* is not solidified), the drive pulse number of the Nb data according to the value Na (thickness of the print sheet 6) stored in the ROM 25 is read out therefrom in order to set an optimum gap between the print head 8 and the print sheet 6 (S13). Thereafter, in S14, (Nm−Nb) is calculated in order to retract the carriage 1 from the present position to the position corresponding to the drive pulse number of the Nb data and the carriage 1 is retracted to that position by inputting the drive pulse number (Nm−Nb) to the step motor 12. At this time, the optimum gap in accordance with the thickness of the print sheet 6 is set between the print head 8 and the print sheet 6.

Thereafter, printing operation is conducted by the print head 8 according to the print order (S16) and the carriage 1 is retracted to the standard position O as just like to S1 (S17). Further, the printed sheet 6 is fed out of the platen 2 in S18, thereafter the procedure is backed to S4.

On the other hand, in S10, if judged YES (in this state, both the guide bar 3 and the carriage 1 cannot mutually rotate since the lubricant filled between the guide bar 3 and the slide hole 1*a* is solidified), the procedure is shifted to S11. In such case, for instance, the value Na becomes bigger than or equal to the NaO at the time when the stop of the carriage 1 is detected because the carriage 1 cannot be moved by the guide bar 3.

In S11, the driving gear 14 is rotated in the direction X' by the step motor 12 until the pin 16 is pressed to the opposite end of the elongated hole 18 and further is moved forcibly toward the direction X'. As a result, the guide bar 3 is forcibly rotated in the slide hole 1*a* relative to the carriage 1, therefore, adhering or fixing between the guide bar 3 and the slide hole 1*a* by the solidified lubricant is removed and the carriage 1 is advanced toward the platen 2. That is to say, during such treatment, the torque received by the driven gear 15 becomes larger and larger according that the pin 16 is moved in the elongated hole 18 and all torque from the step motor 12 is received by the driven gear 15 at the time when the pin 16 is contacted to the opposite end of the elongated hole 18. And at last, the guide bar 3 is forcibly rotated through the swing gear 17 by the driven gear 15, as a result, the adhering or fixing between the guide bar 3 and the slide hole 1*a* by the solidified lubricant is removed. Here, rotational quantity for forcibly rotating the driving gear 14 is predetermined as a drive pulse number input to the step motor 12 and stored in the ROM 25.

Thereafter, the carriage 1 is retracted to the standard position O in S12, as just like to S1, and the procedure is backed to S6. Namely, the procedures of S6–S12 are repeated until the value Na becomes smaller than the NaO and the procedure is shifted to S13 if the value Na becomes smaller than the NaO.

Here, it is possible to judge in S11 that the adhering or fixing between the guide bar 3 and the slide hole 1*a* by the solidified lubricant is removed, based on that the photo-interrupter 21 detects rotations over predetermined number in the turning disk 20.

Figure 3:
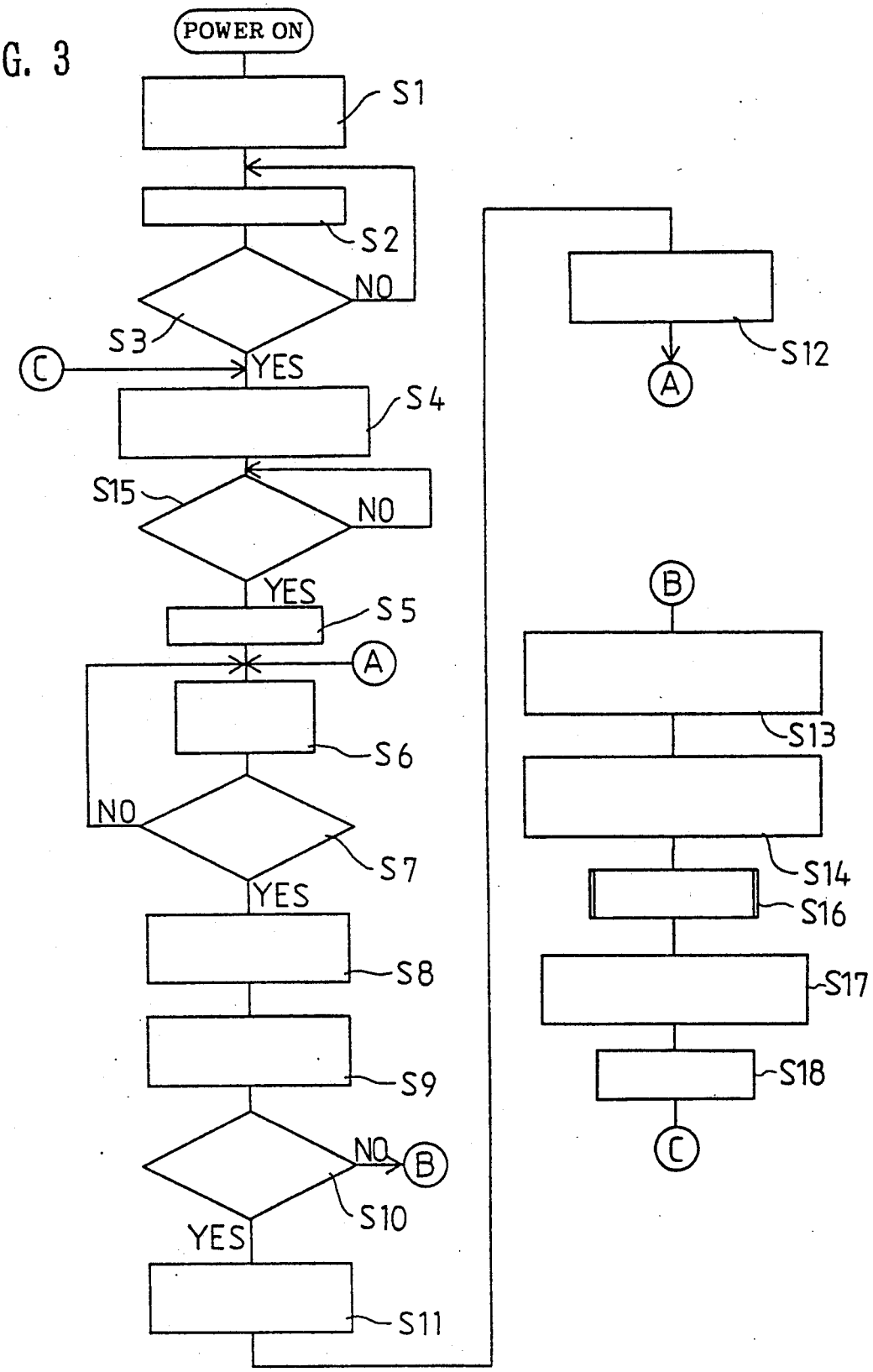
FIG. 3 is a flowchart showing the first control procedure of the adjusting apparatus of the head gap, according to the embodiment of the present invention.

By the above control according to the flowchart shown in FIG. 3, in case that the print order is not input to the printer for a long time in S15, that is, the printer is left in the nonuse state for a long time after powered on, the optimum gap corresponding to the thickness of the print sheet 6 is formed between the print head 8 and the print sheet 6 when the printer is utilized again, thereby high quality printing can be obtained.

Next, the second, the third and the fourth control procedures of the adjusting apparatus will be described referring to FIGS. 4, 5, 6, 7A, 7B, 7C and 7D. These procedures relates to a case in which the adhering or fixing between the guide bar 3 and the slide hole 1*a* by the solidified lubricant is removed when the printer is left in the nonuse state for a long time after the print sheet 6 printed by the print head 8 is removed from the platen 2.

Figure 4:
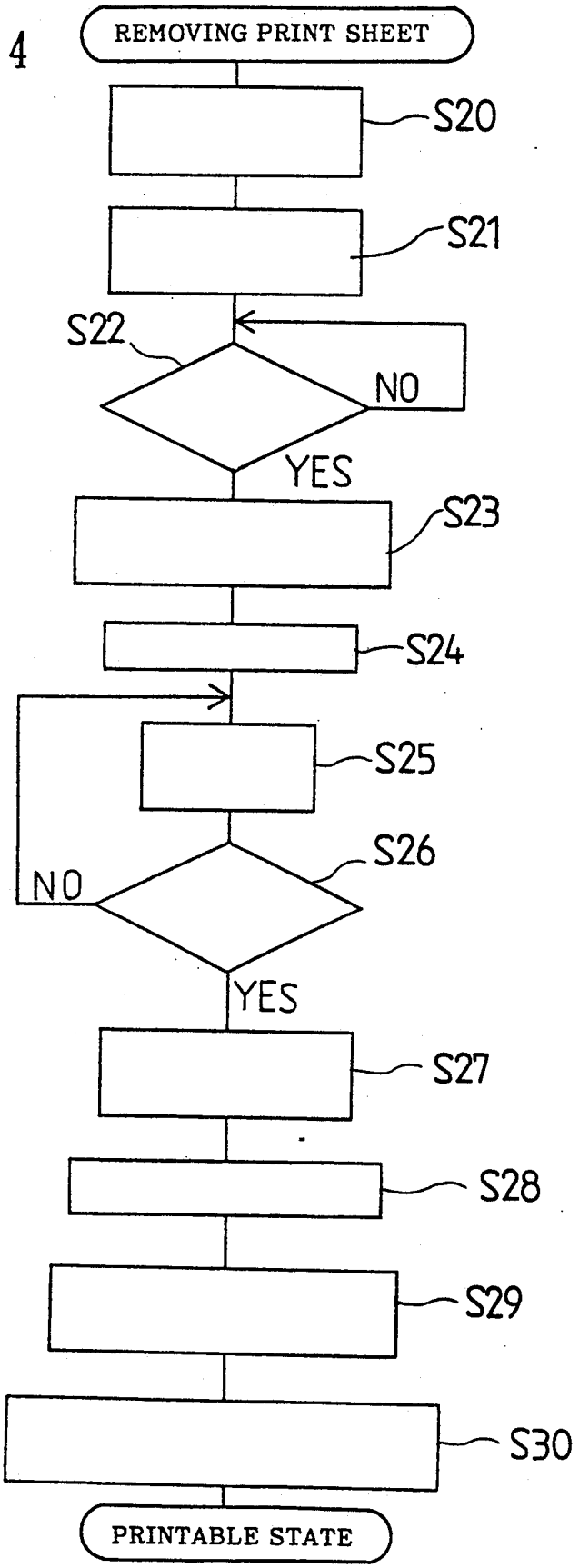
FIG. 4 is a flowchart showing the second control procedure of the adjusting apparatus of the head gap, according to the embodiment of the present invention.

In FIGS. 4 and 7B, after the print sheet 6 is removed from the platen 2, the carriage 1 is retracted to the standard position O in S20, as same in S1. And in S21, the carriage 1 is moved along the guide bar 3 to a position except for the sheet thickness detecting position, the data of which is stored in the ROM 25 as the drive pulse number. Further, in S22, it is judged whether the print order is input to the CPU 24 from the external apparatus, as just like to S15. Also, in this case, if the print order is not input to the CPU 24 for a long time (S22: NO), long waiting state of the procedure will occur while being maintained powering on of the printer. During such waiting state, the lubricant filled between the slide hole 1*a* and the guide shaft 3 will be solidified. If judged YES in S22, the procedure shifts to S23, and contrarily, if judged No, the procedure is waited until the print order is input to the CPU 24.

In S23, the carriage 1 is moved rightward to the sheet thickness detecting position through the drive motor 5 based on the data in the ROM 25. By this operation, the carriage 1 is forcibly moved along the guide bar 3, thereby the adhering or fixing between the guide bar 3 and the slide hole 1*a* by the solidified lubricant is removed. Thereafter, S24–S30 is executed and as a result, the optimum gap corresponding to the thickness of the print sheet 6 is formed between the print head 8 and the print sheet 6. Here, since the operations in S24–30 are as same as the operations in S5–S9, S13, and S14 in the flowchart shown in FIG. 3, detailed description of S24–S30 is omitted. After S30 is executed, the printer becomes printable state and the printing operation is conducted by the print head 8 according to the print order and the carriage 1 is retracted to the standard position O, further the printed sheet 6 is fed out of the platen 2, similar to S16, S17 and S18 in the flowchart of FIG. 3.

According to the second control procedure mentioned above, in case that the print order is not input to the printer for a long time in S22, that is, the printer is left in the nonuse state for a long time after the print sheet 6 is removed from the platen 2, the optimum gap corresponding to the thickness of the print sheet 6 is formed between the print head 8 and the print sheet 6 when the printer is utilized again, thereby high quality printing can be obtained.

Here, in the second control procedure, though the carriage 1 is moved to the sheet thickness detecting position before the print sheet 6 is fed to the platen 2, movement of the carriage 1 to such position can be conducted after the print sheet 6 is fed to the platen 2.

Figure 5:
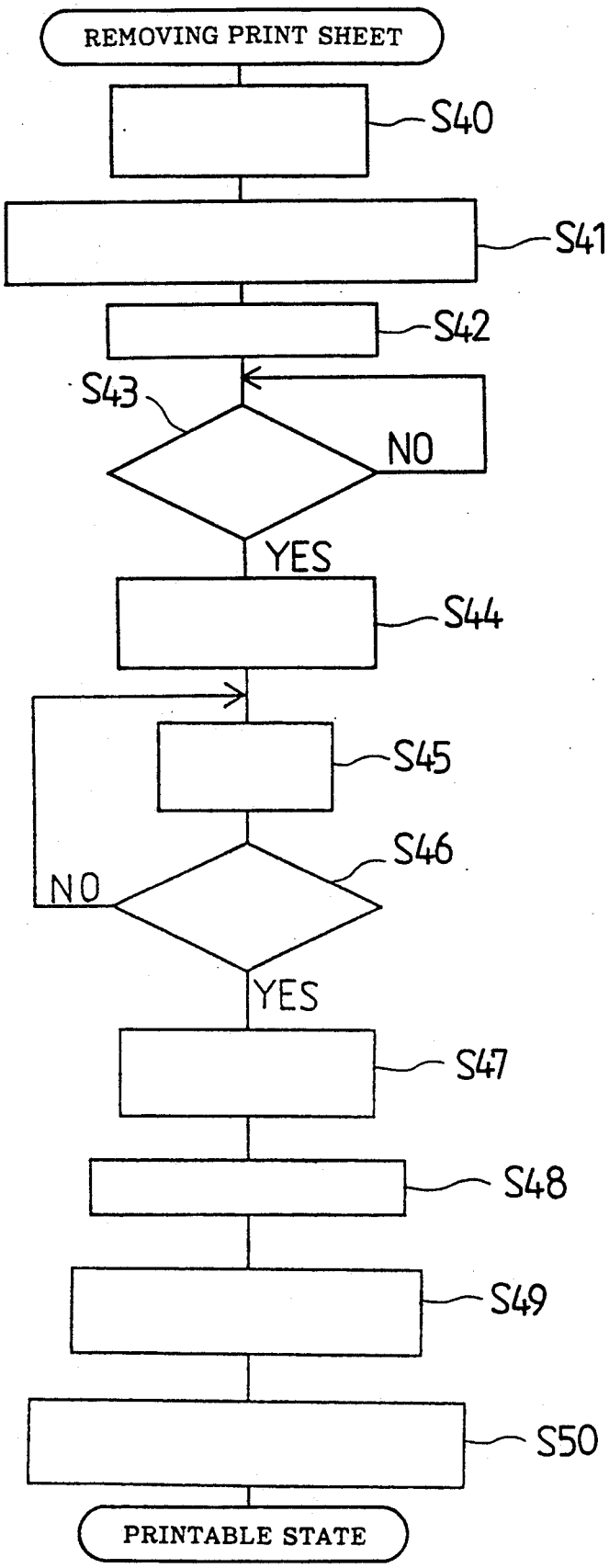
FIG. 5 is a flowchart showing the third control procedure of the adjusting apparatus of the head gap, according to the embodiment of the present invention.

Next, the third control procedure will be described referring to FIGS. 5 and 7C. In FIGS. 5 and 7C, after the print sheet 6 is removed from the platen 2, the carriage 1 is retracted to a position except for the standard position O (for example, the position determined by the NaO data in the ROM 25) in S40. And in S41, the carriage 1 is moved along the guide bar 3 to the sheet thickness detecting position, the data of which is stored in the ROM 25 as the drive pulse number. Thereafter, the print sheet 6 is fed to the platen 2 through the sheet feeding device 10 (S42). And in S43, it is judged whether the print order is input to the CPU 24 from the external apparatus, as just like to S15. Also, in this case, if the print order is not input to the CPU 24 for a long time (S43: NO), long waiting state of the procedure will occur while being maintained powering on of the printer. During such waiting state, the lubricant filled between the slide hole 1*a* and the guide shaft 3 will be solidified. If judged YES in S43, the procedure shifts to S44, and contrarily, if judged No, the procedure is waited until the print order is input to the CPU 24.

Further, in S44, the carriage 1 is forcibly retracted to the standard position O. After this operation, the adhering or fixing between the guide bar 3 and the slide hole 1*a* by the solidified lubricant is removed. Thereafter, S45–S50 are executed and as a result, the optimum gap corresponding to the thickness of the print sheet 6 is formed between the print head 8 and the print sheet 6. Here, since the operations in S45–50 are as same as the operations in S5–S9, S13, and S14 in the flowchart shown in FIG. 3, detailed description of S54–S50 is omitted. After S50 is executed, the printer becomes printable state and the printing operation is conducted by the print head 8 according to the print order and the carriage 1 is retracted to the standard position O, further the printed sheet 6 is fed out of the platen 2, similar to S16, S17 and S18 in the flowchart of FIG. 3.

According to the third control procedure mentioned above, in case that the print order is not input to the printer for a long time in S43, that is, the printer is left in the nonuse state for a long time after the print sheet 6 is removed from the platen 2, the optimum gap corresponding to the thickness of the print sheet 6 is formed between the print head 8 and the print sheet 6 when the printer is utilized again, thereby high quality printing can be obtained.

Finally, the fourth control procedure will be described referring to FIGS. 6 and 7D. In FIGS. 6 and 7D, after the print sheet 6 is removed from the platen 2, the carriage 1 is retracted to the standard position O in S60, as same in S1. And the timer 7 starts to count the time after the last driving of the step motor 12 is terminated.

And in S61, the carriage 1 is moved along the guide bar 3 to the sheet thickness detecting position, the data of which is stored in the ROM 25 as the drive pulse number. Further, in S62, it is judged whether the print order is input to the CPU 24 from the external apparatus, as just like to S15. Also, in this case, if the print order is not input to the CPU 24 for a long time (S62: NO), long waiting state of the procedure will occur while being maintained powering on of the printer. During such waiting state, the lubricant filled between the slide hole 1*a* and the guide shaft 3 will be solidified. If judged YES in S62, the procedure shifts to S63, and contrarily, if judged No, the procedure is waited until the print order is input to the CPU 24.

Thereafter, the print sheet 6 is fed to the platen 2 through the sheet feeding device 10 (S63). And it is judged whether the timer 7 have counted X minutes (in this fourth procedure, X is set to 5-10 minutes) in S64. If judged NO in S64 (in this case, both the guide bar 3 and the carriage 1 are mutually rotatable since the lubricant filled between the guide bar 3 and the slide hole 1*a* is not solidified), the procedure shifts to S67-S72 for gap adjusting. If judged YES in S64 (in this case, both the guide bar 3 and the carriage 1 are not mutually rotatable since the lubricant filled between the guide bar 3 and the slide hole 1*a* is solidified), the carriage 1 is advanced toward the platen 2 in S65, as same in S11. Here, moving distance of the carriage 1 is predetermined as a drive pulse number input to the step motor 12 and stored in the ROM 25. After this operation, the adhering or fixing between the guide bar 3 and the slide hole 1*a* by the solidified lubricant is removed. Thereafter, the carriage 1 is retracted to the standard position O in S66 and the procedure is shifted to S67.

Thereafter, S67-S72 are executed and as a result, the optimum gap corresponding to the thickness of the print sheet 6 is formed between the print head 8 and the print sheet 6. Here, since the operations in S67-72 are as same as the operations in S5-S9, S13, and S14 in the flowchart shown in FIG. 3, detailed description of S67-S72 is omitted. After S72 is executed, the printer becomes printable state and the printing operation is conducted by the print head 8 according to the print order and the carriage 1 is retracted to the standard position O, further the printed sheet 6 is fed out of the platen 2, similar to S16, S17 and S18 in the flowchart of FIG. 3.

As mentioned above, in the fourth control procedure, since the carriage 1 is driven in order to remove the adhering or fixing between the guide bar 3 and the slide hole 1*a* by the solidified lubricant before gap adjusting procedure is conducted, in only the case that the timer 7 counts the predetermined X minutes, it is unnecessary to drive the carriage 1 before gap adjusting procedure every time when the printer is utilized. As a result, the time necessary for gap adjusting can be shortened.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A printer having a platen supporting a print sheet thereon, a carriage mounting a print head thereon, a first guide means for guiding the carriage in a first direction parallel to an axial direction of the platen, a first drive means for moving the carriage while guiding through the first guide means, a second guide means for guiding the carriage in a second direction right to the axial direction of the platen and a second drive means for moving the carriage while guiding through the second guide means, the printer comprising:

a sheet thickness detection means for detecting a thickness of the print sheet by advancing the carriage to the print sheet with a first predetermined driving force through the second drive means until the carriage is stopped, a gap setting means for setting a predetermined gap corresponding to the thickness detected by the sheet thickness detection means between the print head and the print sheet supported on the platen, a comparison means for comparing a value of the thickness detected by the sheet thickness detection means with a predetermined value, and a control means for controlling at least one of the first drive means and the second drive means so as to forcibly move the carriage with a second predetermined driving force larger than the first predetermined driving force in the first direction or the second direction before the predetermined gap is set by the gap setting means when it is judged by the comparison means that the value of the thickness is bigger than or equal to the predetermined value.

2. The printer according to claim 1, wherein the first guide means includes a slide hole formed in the carriage in the first direction and a guide bar passed through the slide hole.

3. The printer according to claim 2, wherein a lubricant with solidability is filled between the slide hole and the guide bar.

4. The printer according to claim 3, wherein the second guide means includes a pair of eccentric shafts formed on both ends of the guide bar, one of which being connected to the second drive means, thereby the guide bar is eccentrically rotatable relative to the slide hole around the eccentric shafts by the second drive means so that the carriage is moved in the second direction.

5. The printer according to claim 4, wherein the second drive means includes a swing gear fixed to one end of the eccentric shaft, a second step motor, a gear train arranged between the swing gear and the second step motor so that rotation of the second step motor is transmitted to the eccentric shaft through the swing gear and a spring means arranged in the gear train which has a biasing force to advance the carriage to the print sheet along the second direction by rotating the eccentric shaft through the swing gear.

6. The printer according to claim 5, wherein the first predetermined driving force is corresponded to the biasing force of the spring means.

7. The printer according to claim 6, wherein the spring means is a twist coil spring.

8. The printer according to claim 4, wherein the comparison means judges that the lubricant is solidified when the value of the thickness detected by the sheet thickness detection means is bigger than the predetermined value.

9. The printer according to claim 5, wherein the predetermined gap, the value of the thickness and the predetermined value are represented as drive pulse numbers for the second step motor, respectively.

10. The printer according to claim 9, further comprising a memory means and the drive pulse number is stored in the memory means.

11. The printer according to claim 1, wherein the print head is a wire print head in which a plurality of print wires are installed.

12. A printer having a platen supporting a print sheet thereon, a carriage mounting a print head thereon, a first guide means for guiding the carriage in a first direction parallel to an axial direction of the platen, a first drive means for moving the carriage while guiding through the first guide means, a second guide means for guiding the carriage in a second direction right to the axial direction of the platen and a second drive means for moving the carriage while guiding through the second guide means, the printer comprising:

a sheet thickness detection means for detecting a thickness of the print sheet, a gap setting means for setting a predetermined gap corresponding to the thickness detected by the sheet thickness detection means between the print head and the print sheet supported on the platen, a control means for always controlling the first drive means so that the carriage is forcibly moved to a first position in the first direction after printing by the print head is terminated and thereafter moved to a second position in the first direction, before detecting the thickness of the print sheet by the sheet thickness detection means.

13. A printer having a platen supporting a print sheet thereon, a carriage mounting a print head thereon, a first guide means for guiding the carriage in a first direction parallel to an axial direction of the platen, a first drive means for moving the carriage while guiding through the first guide means, a second guide means for guiding the carriage in a second direction right to the axial direction of the platen and a second drive means for moving the carriage while guiding through the second guide means, the printer comprising:

a sheet thickness detection means for detecting a thickness of the print sheet, a gap setting means for setting a predetermined gap corresponding to the thickness detected by the sheet thickness detection means between the print head and the print sheet supported on the platen, a timer means for counting a predetermined time since last driving of the second drive means is terminated, a judging means for judging whether the predetermined time is counted by the timer means, a control means for controlling at least one of the first drive means and the second drive means so as to forcibly move the carriage in the first direction or the second direction before detecting the thickness of the print sheet by the sheet thickness detection means when it is judged by the judging means that the predetermined time is counted by the timer means.

14. The printer according to claim 13, wherein the control means controls the first drive means so that the carriage is moved to a first position in the first direction after printing by the print head is terminated and thereafter moved to a second position in the first direction.

15. The printer according to claim 13, wherein the control means controls the second drive means so that the carriage is moved to a third position in the second direction after printing by the print head is terminated and thereafter moved to a fourth position in the second direction.

16. A printer having a platen supporting a print sheet thereon, a carriage mounting a print head thereon, a first guide means for guiding the carriage in a first direction parallel to an axial direction of the platen, a first drive means for moving the carriage while guiding through the first guide means, a second guide means for guiding the carriage in a second direction right to the axial direction of the platen and a second drive means for moving the carriage while guiding through the second guide means, the printer comprising:

a sheet thickness detection means for detecting a thickness of the print sheet, a gap setting means for setting a predetermined gap corresponding to the thickness detected by the sheet thickness detection means between the print head and the print sheet supported on the platen, and a control means for always controlling the second drive means so that the carriage is forcibly moved to a third position in the second direction after printing by the print head is terminated and thereafter moved to a fourth position in the second direction, before detecting the thickness of the print sheet by the sheet thickness detection means.

* * * * *